United States Patent [19]

Bodewein et al.

[11] 4,221,377

[45] Sep. 9, 1980

[54] APPARATUS FOR DECELERATING AND STACKING SHEETS

[75] Inventors: Jakob Bodewein, Mönchengladbach; Günter Hector, Ebenau, both of Fed. Rep. of Germany

[73] Assignee: Jagenberg Werke Aktiengesellschaft, Dusseldorf, Fed. Rep. of Germany

[21] Appl. No.: 966,281

[22] Filed: Dec. 4, 1978

[30] Foreign Application Priority Data

Oct. 12, 1977 [DE] Fed. Rep. of Germany ..... 2755160

[51] Int. Cl. ..... B65H 29/68

[52] U.S. Cl. ..... 271/183; 271/196; 271/216

[58] Field of Search ..... 271/99, 112, 132, 173, 271/183, 196, 204, 211, 216, 229, 231

[56] References Cited

U.S. PATENT DOCUMENTS

| | | | |
|---|---|---|---|
| 2,481,934 | 9/1949 | Langston | 271/183 X |
| 3,279,788 | 10/1966 | Shields | 271/99 |

FOREIGN PATENT DOCUMENTS

| | | | |
|---|---|---|---|
| 1358778 | 3/1964 | France | 271/195 |
| 424309 | 2/1935 | United Kingdom | 271/204 |

*Primary Examiner*—Robert W. Saifer

*Attorney, Agent, or Firm*—Sprung, Felfe, Horn, Lynch & Kramer

[57] ABSTRACT

In an apparatus for cutting, decelerating and overlapping sheets of paper, comprising means for feeding a paper web at predetermined speed, means for cutting said web into sheets, suction means for decelerating the sheets, means for adjusting the amount of suction in relation to the feeding speed, and means for stacking the decelerated sheets, the improvement wherein said suction means includes an ejector roller provided with recesses and located directly in front of the stacking means, at least one suction strip provided in a recess of the ejector roller and extending approximately to the apex of the ejector roller, and at least one nozzle provided in the area of the ejector roller directing air toward the stacker so as to form an air cushion between the sheet being stacked and the sheet which had just previously been stacked.

5 Claims, 3 Drawing Figures

APPARATUS FOR DECELERATING AND STACKING SHEETS

Figure 1:
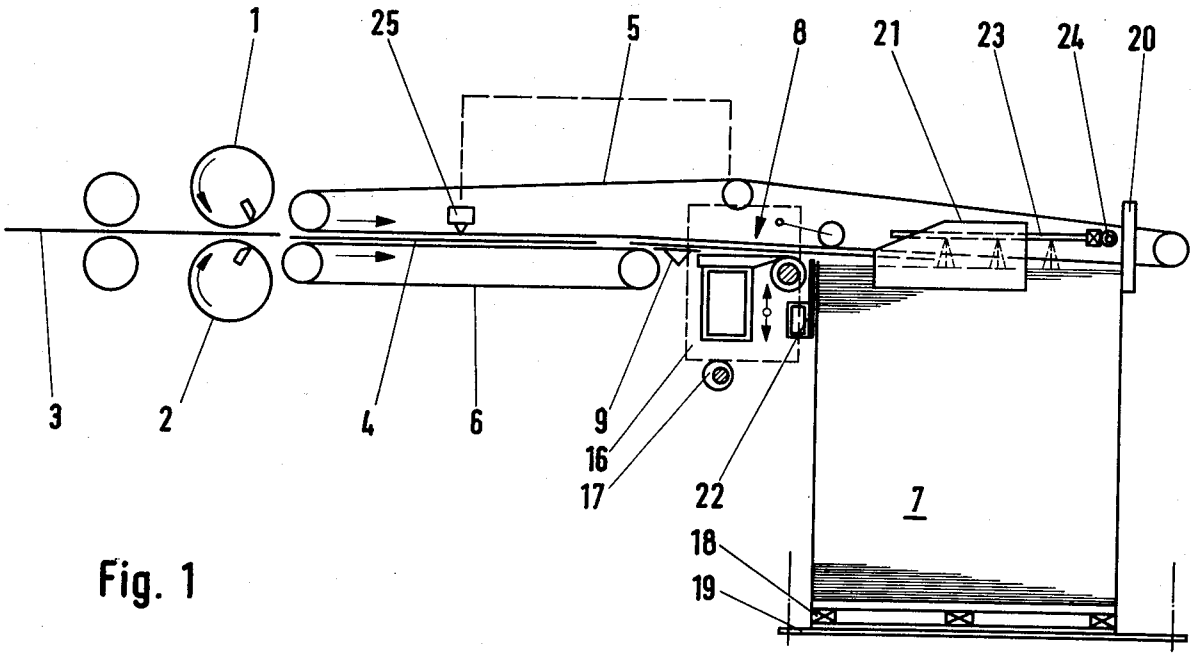

The invention relates to an apparatus for decelerating and overlapping sheets of paper which are transported by conveying means, more specifically one or more conveyor belts, and are stacked in a stacker, the sheets being fed at a specific speed by a feeder, more specifically a cross cutter, and for which there is provided in front of the stacker a decelerating device acting upon the rear parts of the sheets, the effect of the device, more specifically its suction force, being adjustable in proportion to the conveying speed.

In a prior art apparatus of this type (German Patent No. 1,917, 616 and U.S. Pat. No. 3,684,277), the individual sheets cut by the cross cutter are transported by upper and lower conveyor belts to the stacker. On the conveyor track between the next-to-last and the last lower belts, there is a deceleration device provided in the form of a suction box with coverable suction apertures. By opening and closing the suction holes in accordance with the cycle of the sheet feed, the decelerator acts upon the rear part of the sheets. Since a sheet is not only decelerated by the decelerating device but is also deflected downwardly during the decelerating action, the front part of the following sheet can slide over the first sheet which results in overlapping. The overlapped sheets are then further transported by the last lower conveyor belt which extends to the stacker, and by the upper conveyor belt which extends beyond the stacker if necessary. Despite the slowdown of the sheets due to the decelerating device, the conveying speed at maximum output is still too high to prevent any damage to the sheets by their front edge striking against the stop plate of the stacker. On the other hand, however, if the decelerating device would have a more effective slowdown action, the final output would be substantially reduced.

It is therefore an object of the present invention to provide an apparatus of the type described which can be operated while high output is maintained, and without the risk of damaging the front edges of the sheets for striking the stop plate of the stacker too hard.

The object of the present invention is realized by a decelerating device wherein an ejector roller is provided directly in front of the stacker, the ejector roller having recesses and suction strips being provided in these recesses of the ejector roller, the suction strips extending approximately to the apex of the ejector roller, and nozzles being provided below them in the area of the ejector roller, the nozzle aperture pointing in the direction of the stacker.

Since the decelerating device is located directly in front of the stacker, the sheets are transported practically at maximum speed over the entire stretch of the conveyor belts. The combination of ejector roller and tangential conveyor belts, together with suction strips and blower nozzles ensures the safe slowdown of the rear part of the sheets. The blower nozzles produce an air cushion below the already stacked sheets and the sheet to be decelerated, such that the front and center areas of the decelerated sheet floating on an air cushion are slowed down by the rear part of the sheet, thus keeping the sheet rigid. The combination of suction-decelerating device according to the invention not only permits higher output of the apparatus but also a more compact setup than that of the known apparatus.

The transport means provided above the conveying level, more specifically one conveyor belt or a set of conveyor belts, extend advantageously into this area, specifically to the end of the stacker, thereby aiding in conveying the front part of the sheet and thus keeping the sheet rigid during the decelerating action.

However, it is one disadvantage in this apparatus, that the sheets or packs of sheets tend to adhere to the conveying means due to adhesion or electrostatic charges, and thus, according to a further embodiment of the invention, there can be blow nozzles provided directly in front of the stacker and below the conveyor level, the air blowing through the nozzles toward the back part of the sheets to be stacked, and there can further be provided above the front part of the stacker, nozzles with air blowing downwardly into the front area of the sheets to be stacked. The nozzles blowing air against the back parts of the sheets can be identical with those nozzles below the suction strips in the area of the ejector roller. If the conveying means comprises individual belts which are spaced apart from each other, blower nozzles, or more specifically blower strips, are advantageously provided between the spaces. An apparatus of this type with air nozzles blowing onto the back and front areas of the sheets cannot only be used in combination with the suction-decelerating device according to the invention, but quite generally also when the conveying means extends beyond the stacker and there is a tendency that the sheets adhere to the conveying means due to adhesion or electrostatic charges. Even in this case, the use of air blowers ensures the safe stacking of the sheets.

Figure 2:
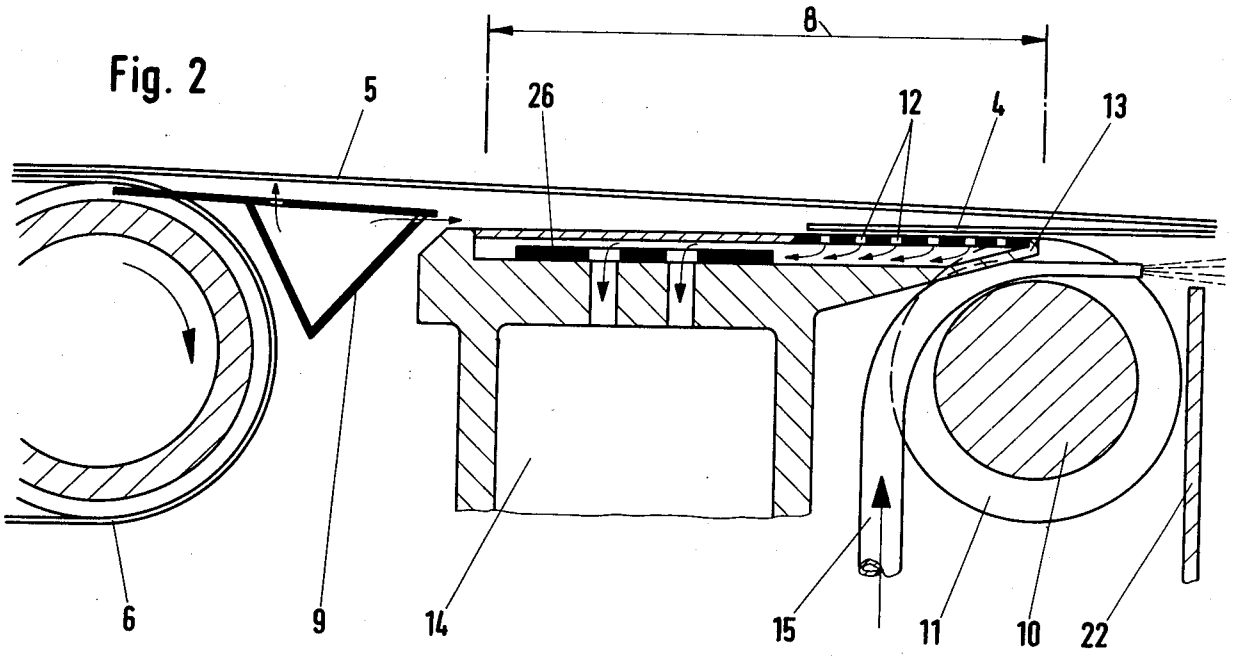
Figure 3:
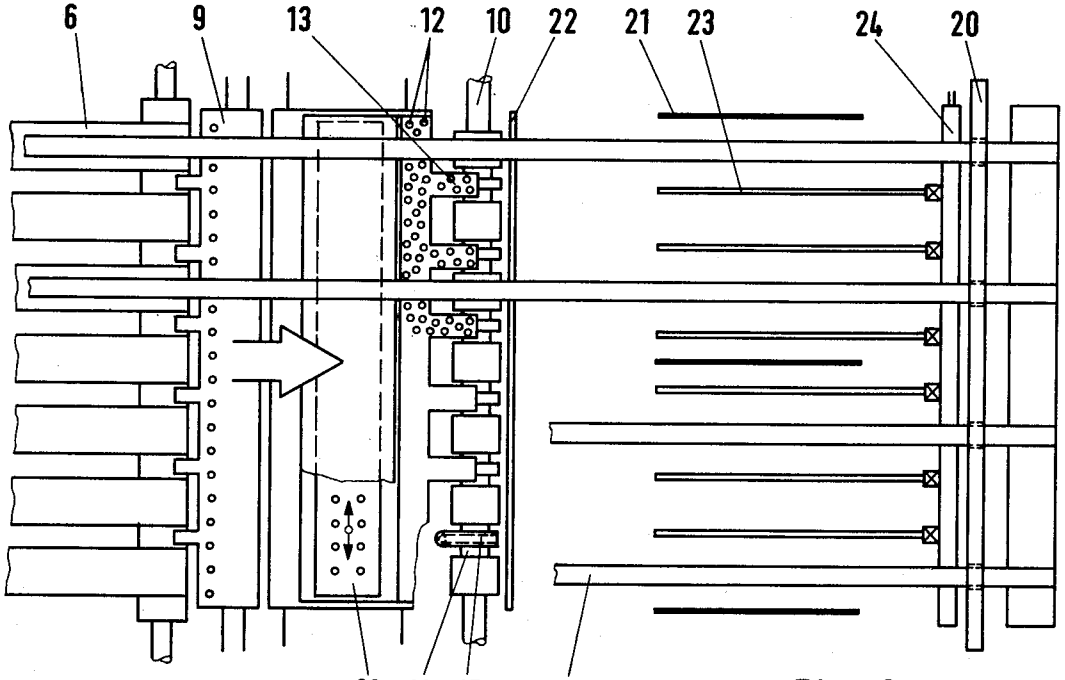

One embodiment of the apparatus according to the invention is described in more detail with reference to the drawings, wherein FIG. 1 is a schematic drawing showing in a side view a device for decelerating and overlapping of sheets to be conveyed to a stacker;

FIG. 2. is an enlarged section of FIG. 1, showing a side view of the decelerating device provided directly in front of the stacker; and FIG. 3 is the stacker according to FIG. 1 in a top view.

Referring now to FIG. 1, the web of material is cut into separate sheets 4 by a cross cutter, consisting of a top knife roller 1 and a bottom knife roller 2. The sheets are transported toward the stacker 7 between upper and lower conveyor belts 5, 6 which travel over rollers. Between the end of the conveyor belt 6, advantageously comprising a plurality of individual belts which are spaced apart, and the stacker 7, there is provided a decelerating device 8 below the conveying level. To prevent sheets which are conveyed at high speed from following the lower conveyor belt 6 down the rear guide roller, and to force them to the decelerating device 8, there is provided a triangular hollow traverse 9 in the upper area of the guide roller on its downward side, which, by means of air blown tangentially against the forward direction of the guided conveyor belt 6, pushes the front edges of the arriving sheets away from the conveyor belt and presses them against the conveyor belt 5 which extends beyond the decelerating device 8.

The decelerating device 8 comprises an ejector roller 10 which is provided with a plurality of recesses 11. Like prongs, there are suction strips 13 extending into these recesses 11, provided with suction apertures 12 and connected to a joint suction box 14. The suction strips 13 extend approximately to the apex of the ejector roller 10. Underneath the suction strips 13, there are provided air nozzles 15 in each recess 11, blowing toward the stacker and thus against the back part of the sheets to be stacked. The ejector roller 10, the suction strips 13 with their joint suction box 14 and the air nozzles 15 are arranged in a housing 16 and are adjustable in height by means of an eccentric 17.

The stacker 7 comprises a height-adjustable platform 19 carrying a pallet 18, a stop 20 for the front edges of the sheets, lateral guides 21 and a front jolter 22.

The conveyor belt 5 extending beyond the stacker 7 comprises a plurality of individual belts which are arranged spaced apart from each other. There are blower strips 23 provided between the belts, the strips having nozzles which are blowing air downwardly onto the sheets to be stacked. The blow strips 23 are supported by a joint hollow traverse 24 which supplies the strips with air.

The apparatus according to the present invention operates as follows:

The sheets being fed from the cross cutter to the conveying track are held between the upper and lower conveyor belts 5 and 6 and are transported at high speed toward the stacker 7. By means of blow air escaping from the hollow traverse 9 the sheets are lifted up at the end of conveyor belt 6 and are pressed against the continuing upper conveyor belt 5. When the front and center part of the sheet passes over the decelerating device 8, the device is not yet in operation. It is activated only when the last part of the sheet is above the decelerating device 8. A sensor 25 provided in the conveyor track is used therefor, the sensor opening the suction apertures 12 of the suction strips 13 by means of a control device. Cover plates 26 such as those in German Patent No. 1,917,616 can be the means which regulate the suction effect in the suction apertures 12 of the suction strips 13. When the decelerating device 8 is activated, the back parts of the sheets are sucked down onto the suction strips 13 and are thus decelerated. The decelerating effect can be controlled by the amount of low pressure in the suction box 14 and also by the length of time of the suction action. The sheets are slowed down such that they have sufficient kinetic energy left after leaving the ejector roller 10 to reach the stop 20 and to strike same without any damage to the sheets. During the deceleration, the sheets must be guided safely, and this is ensured by the ejector roller 10 in combination with the conveyor belts 5 which are tangential to the roller 10. To prevent the front edges of the sheets from slowing down due to friction on the already stacked sheet, before reaching stop 20, nozzles 15 blow air between the sheet to be stacked and the sheet already stacked such that the sheet to be stacked floats on an air cushion.

At a low transport speed of the sheets, i.e. during startup of the machine, the decelerating device is not yet operative. Only above a specific conveying speed are the sheets decelerated by using the low pressure in the suction box 14. The speed at which deceleration will become necessary is dependent upon the type of sheet material to be processed. When the transport speed increases further, the low pressure in the suction box is increased in proportion to the speed.

It is thus ensured that, at any speed, the sheet is safely conveyed to the stop but strikes it only with such force as does not damage the sheet.

It will be appreciated that the instant specification and examples are set forth by way of illustration and not limitation, and that various modifications and changes may be made without departing from the spirit and scope of the present invention.

What is claimed is:

1. In a paper sheet feeding apparatus having means for successively conveying flexible sheets of paper at a predetermined speed, means for decelerating the conveyed sheets from the predetermined speed prior to being stacked, the improvement wherein the conveying means includes means for lowering the trailing edge portion of a conveyed sheet with respect to the leading edge portion of the next successive sheet, wherein the decelerating means includes means for applying a suction force on the trailing edge portion of each conveyed sheet in proportion to the predetermined conveying speed to effect an overlap of the trailing edge portion of the decelerated sheet by the relatively higher leading edge portion of the next successive sheet, the suction means comprising an ejector roller disposed directly upstream of the stacking means and having recesses and at least one suction strip in the recesses of the ejector roller and extending approximately to the apex thereof and at least one nozzle in the vicinity of the ejector roller to form an air cushion between the decelerated sheet and the previously stacked sheet.

2. An apparatus according to claim 1, wherein the conveying means includes at least one conveyor belt extending into the area of the stacking means.

3. An apparatus according to claim 1, including at least one nozzle above the stacking means for directing air downwardly toward the leading edge portion of the sheet being stacked.

4. An apparatus according to claim 1, wherein the conveying means includes a plurality of spaced belts, a nozzle being provided in each space between adjacent belts, each nozzle being in the form of a strip.

5. An apparatus according to claim 4, wherein the conveying means includes at least one conveyor belt extending into the area of the stacking means, and further including at least one nozzle above the stacking means for directing air downwardly toward the front portion of the sheet being stacked.

* * * * *

UNITED STATES PATENT AND TRADEMARK OFFICE

CERTIFICATE OF CORRECTION

PATENT NO. : 4,221,377

DATED : Sep. 9, 1980

INVENTOR(S) : Jakob Bodewein et al

It is certified that error appears in the above-identified patent and that said Letters Patent are hereby corrected as shown below:

Title Page Priority Delete "Oct. 12," and insert --Dec. 10,--.

Signed and Sealed this

Twelfth Day of May 1981

[SEAL]

Attest:

RENE D. TEGTMEYER

Attesting Officer

Acting Commissioner of Patents and Trademar